US011384491B2

(12) United States Patent
Lange et al.

(10) Patent No.: US 11,384,491 B2
(45) Date of Patent: Jul. 12, 2022

(54) ONE-PIECE BRIDGE TIE RESTRAINING CLIP

(71) Applicant: Norfolk Southern Corporation, Norfolk, VA (US)

(72) Inventors: Dustin Lange, Newnan, GA (US); Robert Gannon, Charlotte, NC (US)

(73) Assignee: Norfolk Southern Corporation, Atlanta, GA (US)

( * ) Notice: Subject to any disclaimer, the term of this patent is extended or adjusted under 35 U.S.C. 154(b) by 471 days.

(21) Appl. No.: 16/596,880

(22) Filed: Oct. 9, 2019

(65) Prior Publication Data

US 2020/0115862 A1 Apr. 16, 2020

Related U.S. Application Data

(60) Provisional application No. 62/745,141, filed on Oct. 12, 2018.

(51) Int. Cl.
*E01D 19/12* (2006.01)
*E01B 29/06* (2006.01)

(52) U.S. Cl.
CPC ..... *E01D 19/12* (2013.01); *E01B 29/06* (2013.01)

(58) Field of Classification Search
CPC ... E01D 19/12; E01B 3/00; E01B 3/08; E01B 3/20; E01B 3/24; E01B 3/48; E01B 21/04;

(Continued)

(56) References Cited

U.S. PATENT DOCUMENTS 643,477 A 2/1900 Darby
2,340,824 A 2/1944 Shieber
(Continued)

FOREIGN PATENT DOCUMENTS

DE 3112025 A1 10/1981
DE 3112025 A * 10/1982 ..... E01D 19/12
(Continued)

OTHER PUBLICATIONS

"Bridge Tie Anchors" (web pages), Rails Company (Maplewood, New Jersey); Date of Publication: Unknown; earliest web archive dated Oct. 6, 2008; retrieved from web archive on Jan. 24, 2020 (URL: web.archive.org/web/20081006 070340/http://railsco.com/~bridge_tie_anchors.htm).

(Continued)

*Primary Examiner* — Zachary L Kuhfuss
*Assistant Examiner* — Cheng Lin
(74) *Attorney, Agent, or Firm* — Morris, Manning & Martin, LLP; Daniel E. Sineway, Esq.

(57) ABSTRACT

Systems, devices, and methods are presented for securing a railroad tie atop a support. In one implementation, a unitary length of metal rod is made into a clip that includes a vertical leg, a horizontal leg, and a resilient hook-shaped portion having a hook point. The hook-shaped portion is made so that the clip is biased toward a seated position, with the hook point positioned beneath part of the support. During installation, the vertical leg is placed through a hole in the railroad tie, driven downward until the resilient hook-shaped portion collapses into a compressed position, and driven further until the hook point moves beyond a free edge of the support and expands into the seated position. The clip secures the railroad tie without any additional parts and without requiring a worker to labor beneath the support.

18 Claims, 6 Drawing Sheets

(58) Field of Classification Search
CPC ..... E01B 29/00; E01B 29/06; E01B 29/10; E01B 29/24; E01B 9/64
See application file for complete search history.

(56) References Cited

U.S. PATENT DOCUMENTS

| | | | | |
|---|---|---|---|---|
| 2,991,857 | A | 7/1961 | Soderberg | |
| 3,552,649 | A | 1/1971 | Burwell | |
| 3,659,784 | A * | 5/1972 | Klosk | E01D 19/12 238/349 |
| 4,687,134 | A * | 8/1987 | Burwell | E01D 19/12 238/349 |
| 4,795,091 | A * | 1/1989 | Burwell | E01D 19/12 238/349 |
| 5,329,672 | A | 7/1994 | Froehlich | |
| 5,507,434 | A | 4/1996 | Chambers | |
| 9,512,573 | B2 * | 12/2016 | Austin | E01D 19/12 |
| 9,739,022 | B1 | 8/2017 | Revenew | |
| 11,236,474 | B2 * | 2/2022 | Fazio | E01B 26/00 |
| 2017/0362785 | A1 | 12/2017 | Austin | |

FOREIGN PATENT DOCUMENTS

| | | | | |
|---|---|---|---|---|
| JP | 2001-09620 | A | 2/2001 | |
| JP | 2017-82400 | A | 5/2017 | |
| KR | 10-0655861 | B1 | 12/2006 | |
| KR | 100817449 | B1 * | 3/2008 | E01D 19/12 |

OTHER PUBLICATIONS

"Patented Quick-Set Hook Bolt System: U.S. Pat. No. 9,512,573" (web pages), Lewis Bolt & Nut Company (La Junta, Colorado); Date of Publication: Unknown; website accessed on Mar. 21, 2018 (URL: www.LewisBolt.com/quick-set-hook-bolt).
"Ever Tight System" (web pages), Lewis Bolt & Nut Company (La Junta, Colorado); Date of Publication: Unknown; website accessed on Mar. 22, 2018 (URL: www.LewisBolt.com/evertight-system).
"Special Bridge Hook Bolt" (web pages); Handan Tiande Railway Accessories Manufacturing Co., Ltd. (Handan, China); Date of Publication: Unknown; DIY Trade (Global B2B Trading Platform), website accessed on Mar. 22, 2018 (URL: www.DiYtrade.com/china/pd/1140 2325/Special_bridge_hook_bolt.html).

* cited by examiner

| Length (in) | Rotation | Angle | Die/Radius (in) |
|---|---|---|---|
| 24.000 | - | 90 | 1.000 |
| 8.485 | - | 90 | 1.000 |
| 4.393 | -45 | 14 | 80.000 |
| 18.097 | - | 126 | 1.500 |
| 3.400 | - | 30 | 25.000 |
| 12.127 | | | |

ONE-PIECE BRIDGE TIE RESTRAINING CLIP

CROSS REFERENCE TO RELATED APPLICATIONS

The present application claims the benefit of and priority to U.S. Provisional Application 62/745,141, filed Oct. 12, 2018, and entitled "One-Piece Bridge Tie Restraining Clip," which is incorporated herein by reference in its entirety.

TECHNICAL FIELD

Certain disclosed embodiments relate to the field of railway construction. More particularly, but not by way of limitation, the present disclosure describes systems and methods for securing railroad ties to bridge supports.

BACKGROUND

A conventional railway bed over land includes rails attached to evenly spaced wooden railroad ties that are partially surrounded by a ballast material, such as crushed stone. Track ballast supports the expected loads, facilitates drainage, and helps to hold the ties and rails in place when trains pass.

Railway beds across bridges and other elevated structures typically do not include any track ballast, which requires the use of another attachment method for holding the ties and rails in place and supporting the load of passing trains. Many of the existing attachment methods involve multiple component parts, extensive training, and dangerous installation by workers both above and beneath the bridge deck.

BRIEF DESCRIPTION OF THE DRAWING

Features of the various implementations disclosed will become more apparent in the following detailed description, in which reference is made to the appended drawing figures. Corresponding reference numbers indicate corresponding parts or elements throughout the several views of the drawing. The various elements shown in the figures are not drawn to scale unless otherwise indicated. The dimensions of the various elements may be enlarged or reduced in the interest of clarity. The several figures depict one or more implementations and are presented by way of example only and should not be construed as limiting. Included in the drawing are the following figures, wherein.

DETAILED DESCRIPTION

Figure 1:
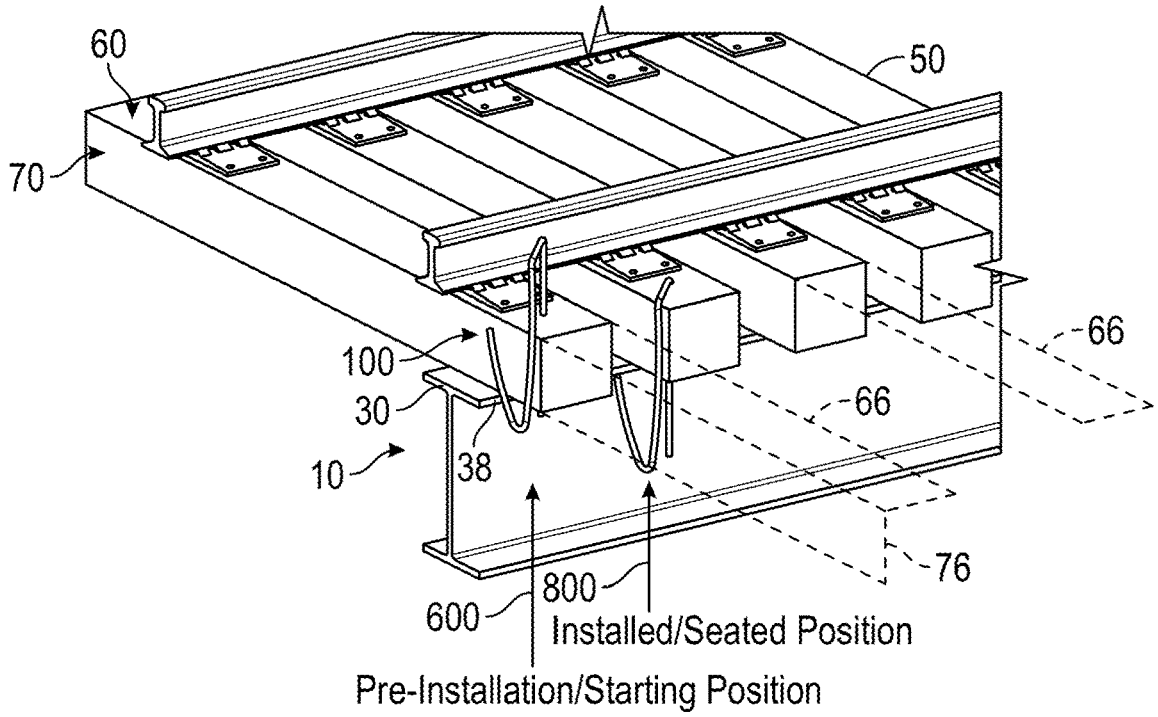
FIG. 1 is a perspective illustration of a one-piece clip for securing a railroad tie to a structural support, according to one particular embodiment.

Various implementations and details are described with reference to an example: a clip for securing a railroad tie atop a support. In one implementation, a unitary length of metal rod is made into a clip that includes a vertical leg, a horizontal leg, and a resilient hook-shaped portion having a hook point. The hook-shaped portion is made so that the clip is biased toward a seated position, with the hook point positioned beneath part of the support. During installation, the vertical leg is placed through a hole in the railroad tie, driven downward until the resilient hook-shaped portion collapses into a compressed position, and driven further until the hook point moves beyond a free edge of the support and expands into the seated position. The clip secures the railroad tie without any additional parts and without requiring a worker to labor beneath the support. Although the various embodiments and implementations are described with reference to securing a generally prismatic railroad tie to a common I-beam, the systems and methods described herein may be applied to and used with any of a variety of structures.

The present systems and apparatuses and methods are understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to a component can include two or more such components unless the context indicates otherwise.

Ranges can be expressed herein as from "about" one particular value and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

As used herein, the term "facilitate" means to aid, assist, or make easier. The term "impede" means to interfere with, hinder, or delay the progress.

As used herein, the terms "proximal" and "distal" are used to describe items or portions of items that are situated closer to and away from, respectively, a user or operator. Thus, for example, the side of an item nearest a person may be referred to as the proximal side, whereas the generally opposing side or far side may be referred to as the distal side.

The present disclosure describes one-piece anchors and methods for securing a railroad tie to a supporting structure, such as a bridge. Currently available anchors for securing railroad ties to bridges include some type of bar or bracket, a drilled hole, and a threaded connector such as a carriage bolt or hook bolt with a matching nut. Installation of such systems is time consuming and difficult. Workers often need to work beneath the bridge deck to drill holes, insert or receive the bolts, or fasten and tighten matching nuts. Below-deck work requires scaffolding from below or suspension from above, both of which increase the risk to workers and add significantly to the time and cost of installation. More broadly, fastening systems with multiple component parts require companies to haul and maintain an inventory of various matching parts, specific tools, and workers who are trained to perform the installation. Teams of two or more workers are generally required when installing a system that includes multiple component parts to be placed in various places, especially opposing sides or opposing ends of a structure.

In addition, many currently available systems are designed so that the railroad ties and the supporting beams are fastened tightly together. Tight connections between rails, ties, and supports, however, can concentrate the high load of a passing train onto particular elements, leading to overload and failure. Looser connections can help to spread the load among and across all the cooperating elements of a railway. Railroad track is a dynamic structure that is designed to flex and move, within limits, to help spread the load of a passing train. Systems that include nuts tightly fastened to bolts can generate unwanted and potentially unsafe load concentrations.

Reference is now made in detail to the example implementations illustrated in the accompanying drawings and discussed below.

Figure 2:
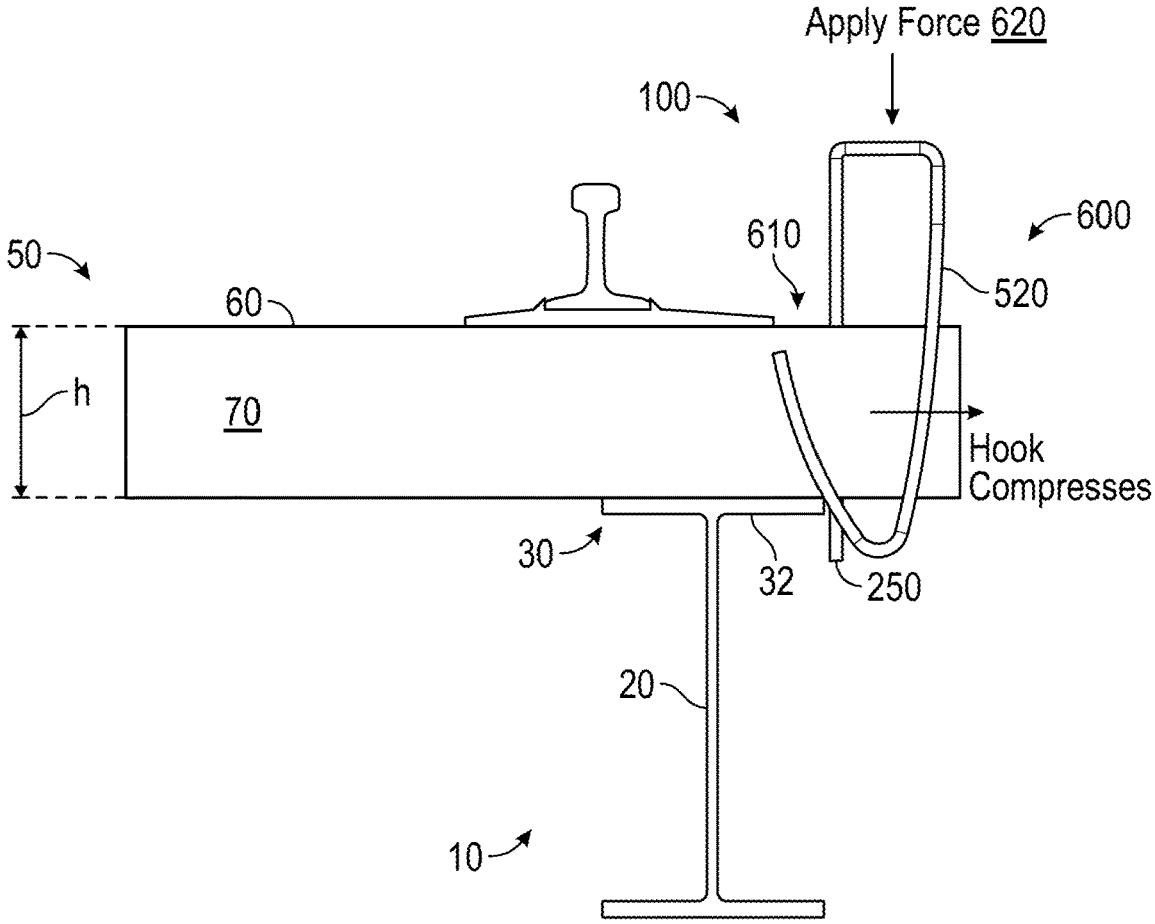
FIG. 2 is a side view of the one-piece clip of FIG. 1 in a starting position.

FIG. 1 is a perspective illustration of a one-piece clip 100 for securing a railroad tie 50 to a structural support 10. The rails, as shown, are supported by a series of evenly spaced railroad ties 50 positioned across one more supports 10. In some implementations, the support 10 is an I-shaped steel beam having a central web or body 20 and a pair of flanges 30 extending outwardly from the body 20. The upper flange 30 has an upper surface (upon which the ties 50 may rest) and a lower surface 32 (FIG. 2). The flange 30 extends outwardly to a free edge 38, as shown in FIG. 1.

In other implementations, the clip 100 may be used with a support 10 having a different size and shape than the I-beam illustrated herein, as long as the support includes an outwardly projecting and relatively flat element such as a rim, collar, or rib, which has a lower surface under which the hook point 550 can rest when the clip is in its seated position.

The surfaces of the railroad tie 50, as shown, are used to define a number of reference planes. As will be understood, the faces, ends, and sides of a railroad tie 50 are generally parallel but do not define a perfectly prismatic geometric solid. Accordingly, the planes described herein are approximations and are useful as a reference or guide for the positioning and installation methods described. The top or upper surface 60 of the tie 58 defines a horizontal plane 66. The front or leading face 70 of the tie 50 defines a vertical plane 76.

Figure 5:
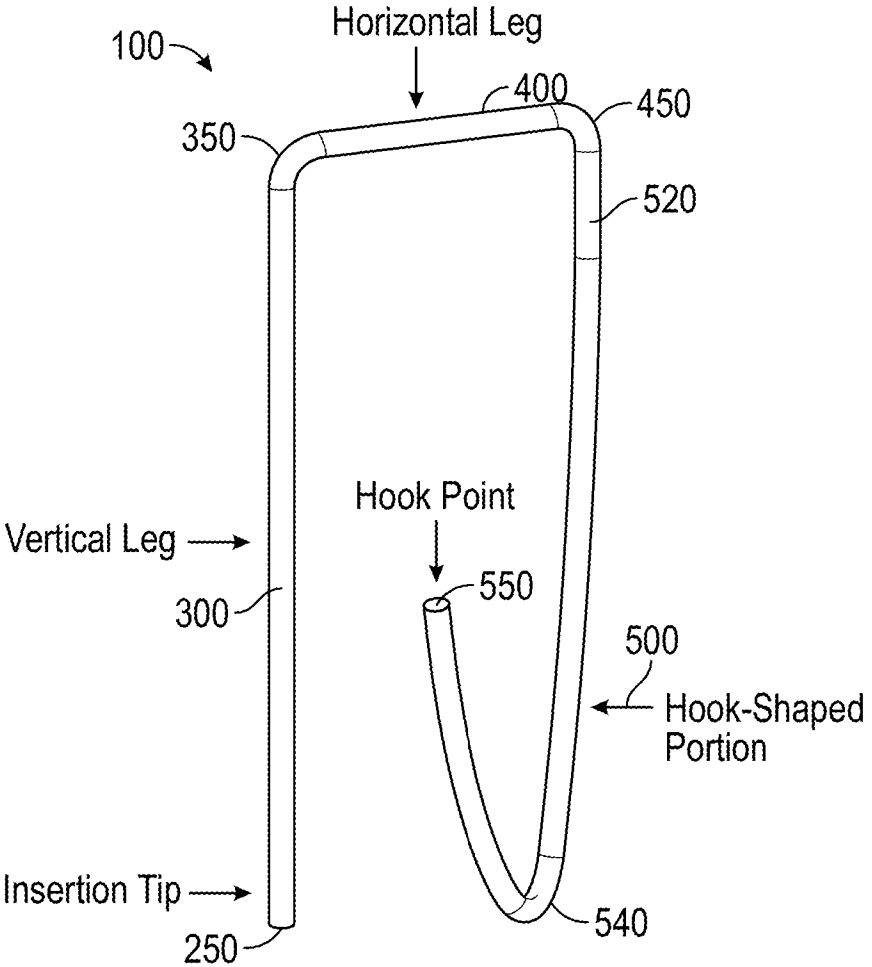
FIG. 5 is an isometric view of the one-piece clip of FIG. 1.

Referring briefly to FIG. 5, the one-piece clip 100, according to one embodiment, is made of a unitary length of rod extending from an insertion tip 250 at one end to a hook point 550 at the other end. The clip 100 may include a vertical leg 300, a first curved interconnected portion 350, a horizontal leg 400, a second curved interconnected portion 450, and a hook-shaped portion 500. The hook-shaped portion 500 includes a shank 520 and a bend 540 that has an arcuate shape.

The clip 100 is resilient, meaning herein that the clip 100 is able to spring back into shape after bending or compression. The clip 100 may be constructed of a material having a stiffness that allows the clip 100 to be resilient. In some embodiments, the clip 100 may be constructed of ASTM A36 400-strength mild steel round bar having a stiffness or yield strength of about 400 MPa and an outside diameter of 0.75 inches. FIGS. 8A-8F is a collection of engineering drawings of the one-piece clip 100 constructed of a single 58-inch long piece of 0.75-inch A36 steel rod, including the lengths of each section, the angular orientations, and the radius of curvature for each bend.

As shown in FIG. 1, on the first railroad tie, the clip 100 is shown in its starting position 600. Part of the vertical leg 300 has been inserted into the tie 50 and the hook-shaped portion 500 lies against or adjacent to the leading face 70 of the railroad tie 50 (and, thus, is co-planar with the vertical plane 76). The horizontal leg 400 is oriented at an acute angle 420 (see FIG. 6) relative to the leading face 70 of the tie 50. Part of the hook-shaped portion 500, as shown, is resting against the free edge 38 of the upper flange 30 of the beam 10.

Figure 10:
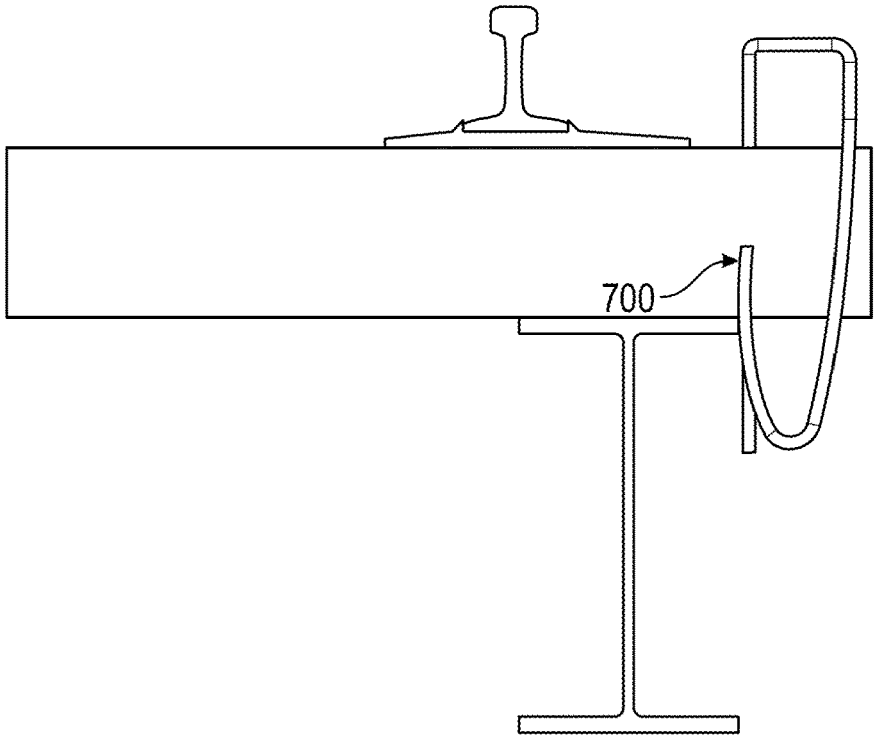
FIG. 10 is a side view of the one-piece clip of FIG. 1 in a compressed position.

FIG. 2 is a side view of the one-piece clip 100 in its starting position 600. Applying a first downward force 620 will drive the clip 100 downward, causing the hook-shaped portion 300 to collapse or compress (in the direction of the arrow in FIG. 2). FIG. 10 is a side view of the one-piece clip in its compressed position 700. The hook point 550 will move closer to the shank 520, causing the hook-shaped portion 500 to collapse or close until the hook point 550 is located at or near the free edge 38 of the flange 30. The downward force may be supplied by a sledgehammer, manually, or by any other of a variety of driving tools.

Figure 11:
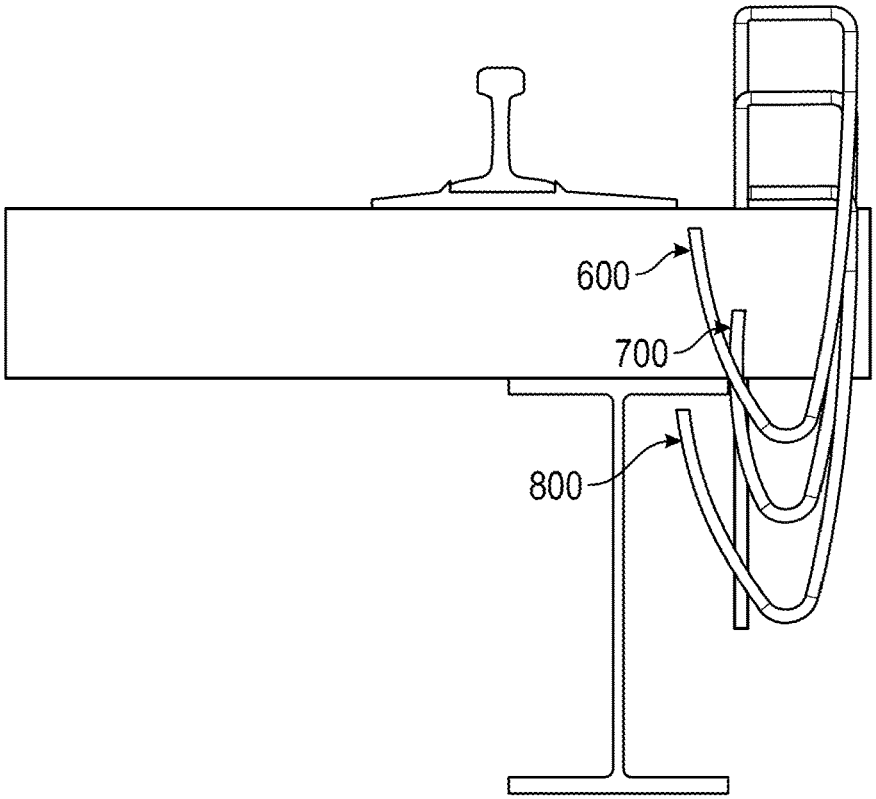
FIG. 11 is a side-view illustration of the one-piece clip of FIG. 1 in a starting position, a compressed position, and a seated position.

FIG. 11 is a side-view illustration of the one-piece clip 100 in three relevant positions: in its starting position 600, its compressed position 700, and its seated position 800. The compressed position 700 is characterized by the hook-shaped portion 500 being compressed and resting against or adjacent the free edge 38 of the flange 30.

Figure 3:
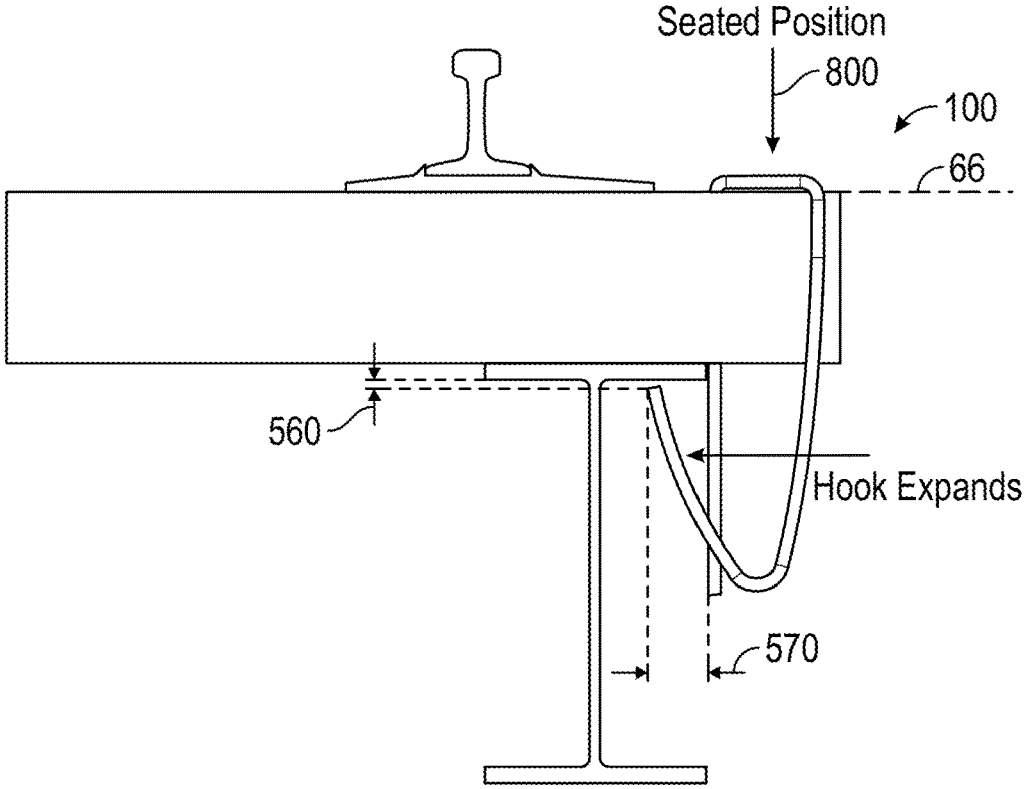
FIG. 3 is a side view of the one-piece clip of FIG. 1 in a seated position.

Applying a second downward force 622 will drive the clip 100 further downward, causing the hook point 550 to move lower, beyond and below the free edge 38, where the hook-shaped portion 300 will expand into a seated position 800 as shown in FIG. 3 (and FIG. 11). In this aspect, the resilient clip is biased toward expanding into the seated position 800. As shown, the hook point 550 is positioned a first vertical distance 560 below the lower surface 32 of the flange 30. When the clip 100 is installed, the first vertical distance 560 may be zero, in which case the hook point 550 is touching the lower surface 32. In some implementations, the first vertical distance 560 is between about one-half inch and one inch. Horizontally, the hook point 550 is positioned a first horizontal distance 570 inward relative to the free edge 38 of the flange 30. In some implementations, the first horizontal distance 570 is between about three inches and four inches. Referring to the embodiment shown in FIG. 8C, the first horizontal distance 570 is about 3.5 inches, as measured from the innermost edge of the vertical leg 300 (which, as shown in FIG. 3, rests against the free edge 38 of the flange 30).

The first vertical distance 560 below the lower surface 32 of the flange 30 will vary according to a variety of factors in the field, such as the size and shape of the railroad tie 50, the extent to which the clip 100 is driven downward into the upper surface 60 of the railroad tie 50, the thickness of the flange 30, and other conditions in the field. In some implementations, the hook point 550 may be properly positioned beneath the lower surface 32, but the horizontal leg 400 is not fully seated against the upper surface 60 of the railroad tie 50, leaving a gap. The system in such an instance may include a shim or a plate that is sized and shaped to be inserted between the horizontal leg 400 and the upper surface 60 of the railroad tie 50, closing the gap.

The first vertical distance 560 below the lower surface 32 of the flange 30 will also vary, of course, according to the thickness or height, h, of the railroad tie 50 (as shown in FIG. 2) and the height of the hook-shaped portion 500 (which, as shown, is roughly equal to the height of the vertical leg 300). In some implementations, where the height of the railroad tie 50 is h, the height of the vertical leg 300 is somewhat more than approximately 2 times h (or 2 h). In use, the crew may have an inventory of clips, each having a particular overall height that is configured for use with a railroad tie 50 having a height, h. For example, the inventory may include clips for railroad ties of various heights, in one-inch increments; for example, where h equals 11 inches, 12 inches, 13 inches, etc. In addition, clips of different sizes may be used when the bridge structure includes an intermediate deck or other layer between the beam support 10 and the railroad ties 50.

Figure 4:
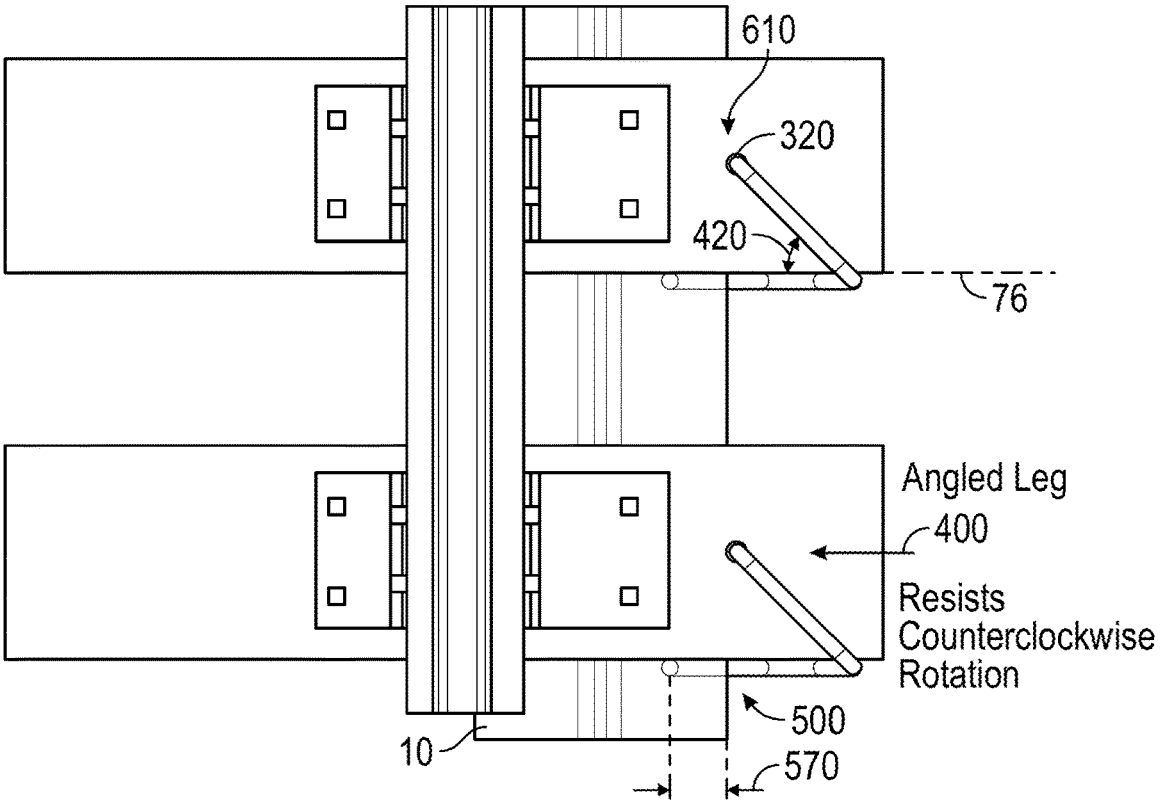
FIG. 4 is a plan view of two railroad ties, each secured by the one-piece clip of FIG. 1.

FIG. 4 is a plan view of two railroad ties, each secured by the one-piece clip 100. The vertical leg 300 of the clip 100 has been inserted into a nearly vertical hole 320 located, in some implementations, near the center of the railroad tie 50. The vertical leg 300, in one embodiment, may have a five-degree chamfer starting about 1.5 inches from the insertion tip 250, as shown in FIG. 8B, to facilitate insertion. The vertical hole 320 may drilled. The hole 320 may also be created in other ways, including but not limited to driving the vertical leg 300 of the clip directly into the railroad tie 50. The hole 320 may have a diameter of ⅞ inch which, for a clip 100 having an outer diameter of ¾ inch, will in general not result in a tight or compression fit between the vertical leg 300 and the hole 320. In this aspect, the connection between the clip 100 and the tie 50 is not strictly tight, but instead is relatively loose. Looser connections, in general, can help to spread the load of a passing train among and across all the cooperating elements of a railway.

As shown in FIG. 4, the horizontal leg 400 is oriented at a first acute angle 420 relative to the vertical plane 76, as shown. The angle 420 may be approximately forty-five degrees. Referring briefly to the direction of compression shown in FIG. 2, the hook-shaped portion 500 of the clip 100 will be driven by the compressive force toward the right in FIG. 4. As the hook-shaped portion 500 is compressed during installation, therefore, the clip 100 will tend to rotate about the vertical leg 300 in a counter-clockwise direction. The acute angle 420 of the horizontal leg 400, together with the position of the hook-shaped portion 500 closely adjacent the leading face 70 of the railroad tie 50, will resist the counter-clockwise rotation of the clip 100—and thereby facilitate the controlled compression and eventual expansion of the clip 100 without unwanted rotation. The clip 100 resists rotation, at least in part, because the angle 420 is acute relative to the hook-shaped portion 500. If the angle 420 were obtuse, the hook-shaped portion 500 would be forced away from the leading face 70 of the railroad tie 40 and the clip 100 would be allowed to rotate counter-clockwise, moving the hook-shaped portion 500 out of alignment with the vertical plane 76 and perhaps causing a failure of the clip 100 to reach a properly seated position 800.

Figure 6:
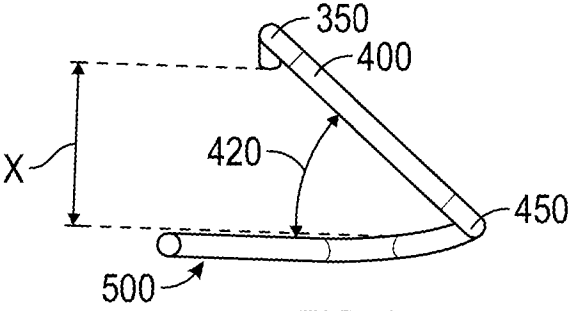
FIG. 6 is a top view of the one-piece clip of FIG. 1.
Figure 7:
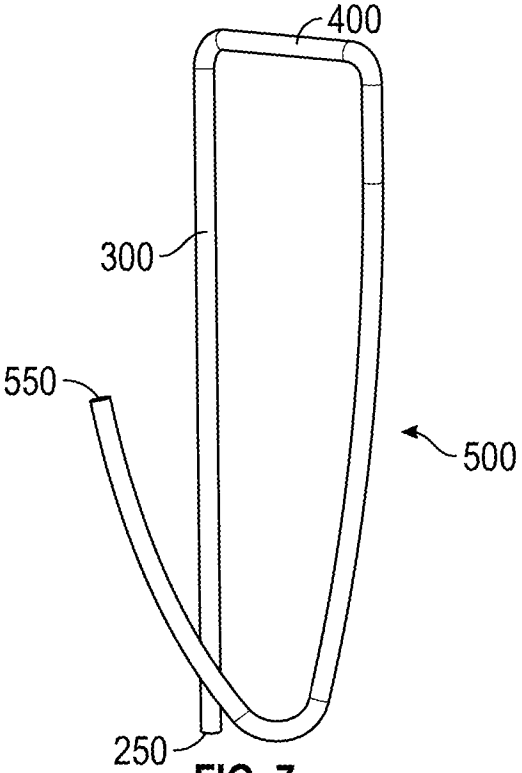
FIG. 7 is a side view of the one-piece clip of FIG. 1.

FIG. 5 is an isometric view of the one-piece clip 100. The hook point 550 may be shaped like the end of a metal rod, as shown, or it may be tapered or chamfered (for example, like the insertion tip 250 shown in FIG. 8B). FIG. 7 is a side view of the one-piece clip. FIG. 6 is a top view of the one-piece clip 100, illustrating the first acute angle 420 between the horizontal leg 400 and the hook-shaped portion 500. In some implementations, the horizontal leg 400 may be sized in length to achieve a distance, X, which is approximately half the width of the railroad tie 50—thereby placing the vertical hole 320 near the center of the tie 50. The size of the horizontal leg 400 for a particular implementation will vary, of course, in accordance with the width of the particular railroad tie to be secured.

The clip 100 may be installed through every railroad tie 50 on a bridge or other support structure, to provide support and stability along the entire structure. In this aspect, the clips 100 work together as a set, spreading and sharing the load of passing trains, in a cooperative system that helps keep the entire railway bed stable. In other implementations, the clips may be installed in every other tie or in a selected grouping of railroad ties in a location where support and stability is needed.

Figure 8E:
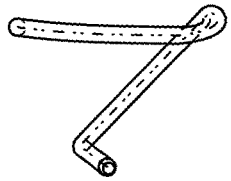
FIGS. 8A through 8F is a collection of engineering drawings of the clip of FIG. 1.
Figure 8F:
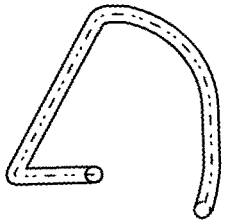
Figure 8A:
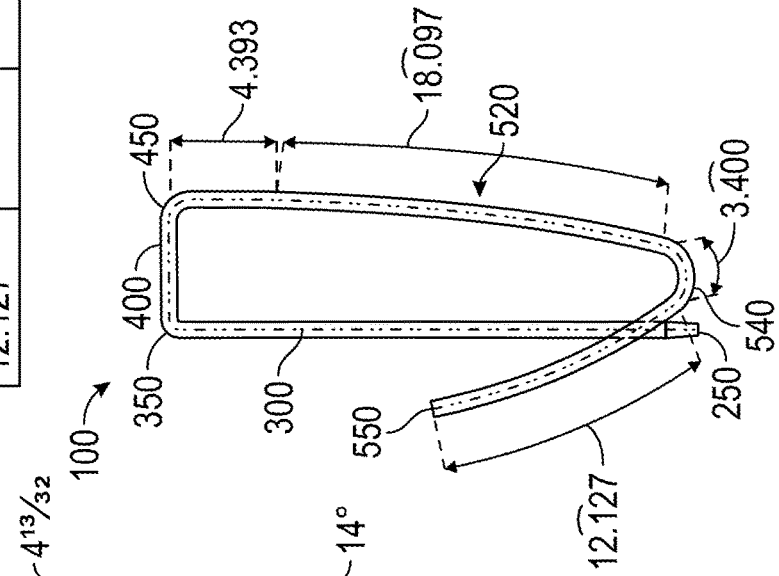
Figure 8C:
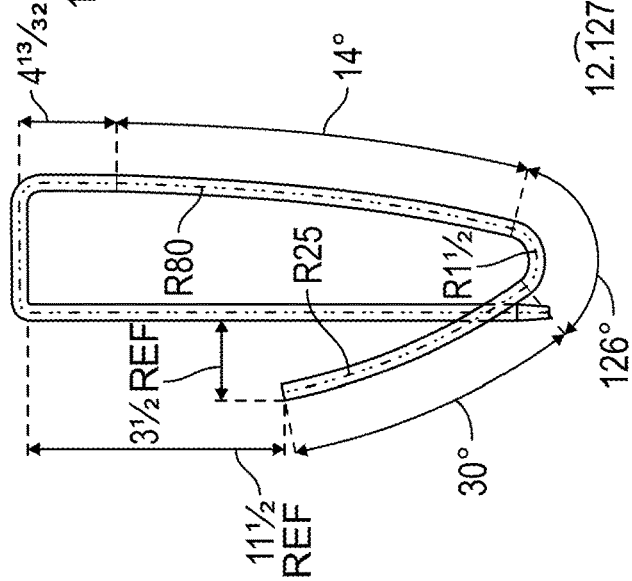
Figure 8D:
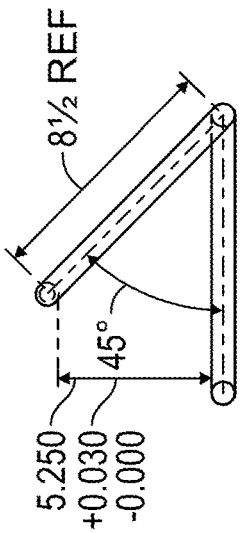
Figure 8B:
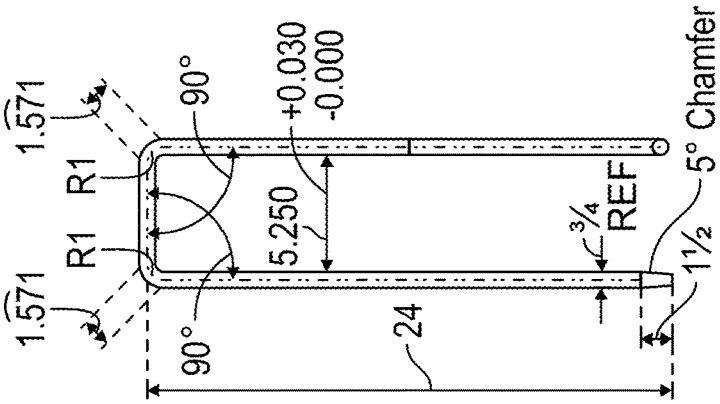

FIGS. 8A through 8F is a series of engineering drawings of the one-piece clip 100, according to one implementation. As shown in FIG. 8A, the clip 100 extends from an insertion tip 250 to a hook point 550. The clip 100 has a vertical leg 300, a first curved interconnected portion 350, a horizontal leg 400, a second curved interconnected portion 450, and a shank 520. The shank 520, as shown, includes a bend 540 and extends to the hook point 550. In the example shown, the shank 520 includes a relatively straight portion having a length of 4.393 inches, a gently curving portion having a length of 18.097 inches, a bend 540 having a length of 3.400 inches, and a final portion having a length of 12.127 inches.

FIG. 8B shows the orientation and dimensions for the clip 100, according to one implementation. The insertion tip 250 may have a five-degree chamfer starting about 1.5 inches from the insertion tip 250. The diameter of the rod is 0.75 inches. The vertical leg 300 has a length of 24 inches. The first curved interconnected portion 350 has a length of 1.571 inches and a radius R1 of one inch. The angle between the first curved interconnected portion 350 and the horizontal leg 400 is ninety degrees. The horizontal leg 400 has a length of 8.5 inches, as shown in FIG. 8D. The second curved interconnected portion 450 has a length of 1.571 inches and a radius R1 of one inch. The angle between the second curved interconnected portion 450 and the first portion of the shank 520 is ninety degrees.

FIG. 8C includes additional details about the shank 520, according to one implementation. Starting from the second curved interconnected portion 450, the first, relatively straight portion has having a length of four and thirteen thirty-seconds of an inch. The gently curving portion has a radius of eighty inches and spans a radial distance of fourteen degrees. The bend 540 has a radius of 1.5 inches and spans a radial distance of 126 degrees. The final, gently curving portion has a radius of 25 inches and spans a radial distance of thirty degrees. The hook point 550 in this view is spaced apart about 3.5 inches from the vertical leg 300, and about 11.5 inches from the horizontal leg 400.

The dimensions shown in FIGS. 8A through 8F are effective for a clip 100 that is sized and shaped for use with a railroad tie 50 of a particular size and shape. As shown in FIG. 8D, for example, the horizontal leg 400 has a length of 8.5 inches and is oriented at an angle of 45 degrees relative to the vertical plane 76 (FIG. 1) in which the hook-shaped portion 500 extends downward along the face 70 of the railroad tie 50. This length and orientation places the hole 320 (into which the vertical leg 300 is placed) at about 5.25 inches from the face 70 of the railroad tie 50. For the hole 320 to be located near the center of the tie 50, the width of the railroad tie 50 is about 10.5 inches. A wider railroad tie would require a clip 100 with a longer horizontal leg 400, in order to maintain the location of the hole 320 near the center of the tie. In this aspect, the width of a particular railroad tie determines, mathematically, the length and orientation of the horizontal leg 400. The mathematical relationship between the length and orientation of the horizontal leg 400 and the tie width can be maintained for any of a variety of railroad tie sizes and shapes.

Figure 9:
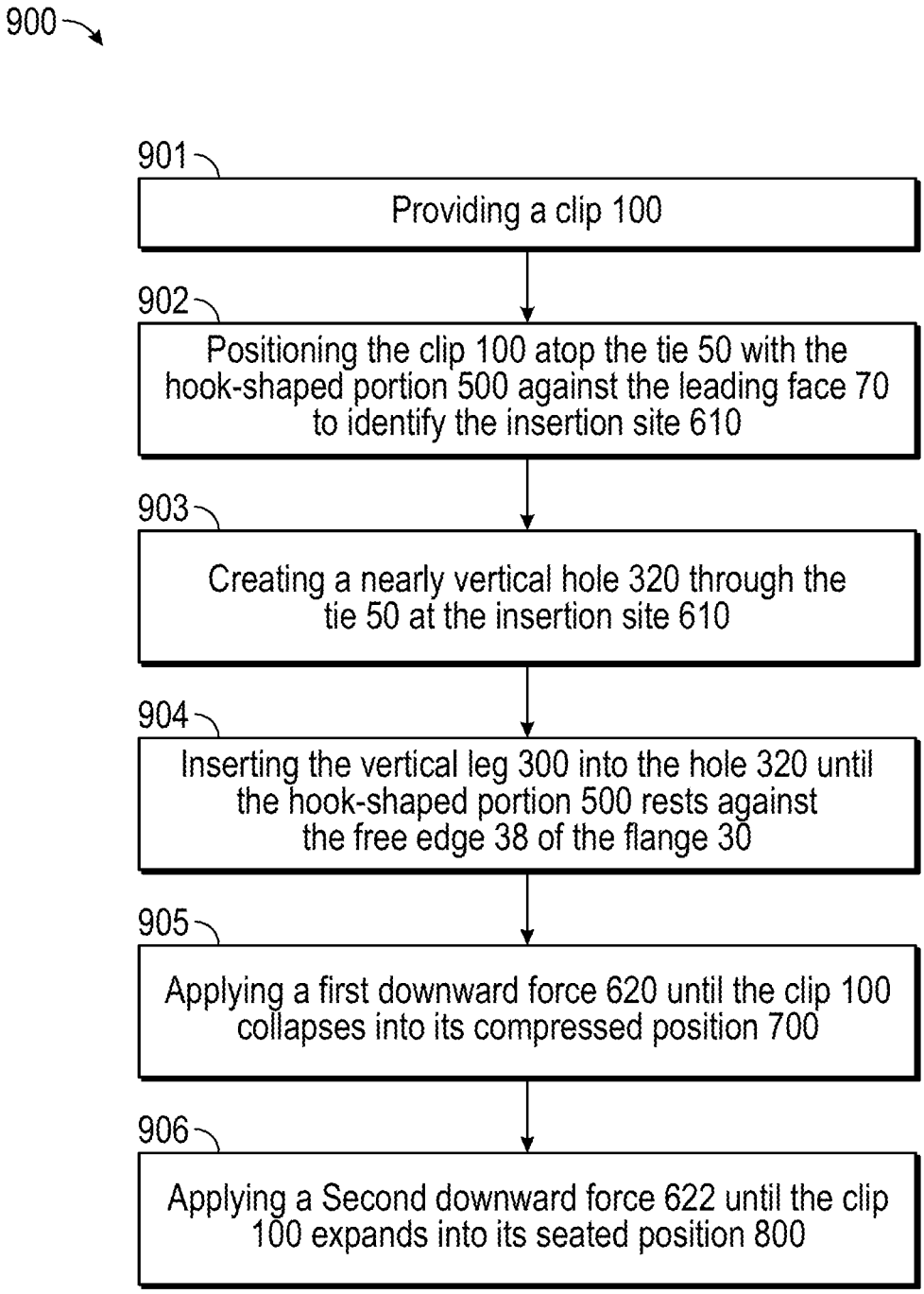
FIG. 9 is a flow diagram of an example method of installing the one-piece clip.

FIG. 9 is a flow diagram of an example method 900 of installing the one-piece clip 100. For example, the method 900 may be used to secure a railroad tie 60 to a bridge support 10, as described herein. Step 901 includes providing a clip 110 comprising a unitary length of rod formed into a vertical leg 300 having an insertion tip 250, a horizontal leg 400, and a hook-shaped portion 500 having a hook point 550.

At step 902, a worker may start the installation method 900 by positioning the clip 100 atop the railroad tie 50 with (1) the insertion tip 250 positioned onto or adjacent the upper surface 60 of the tie 50, (2) the hook-shaped portion 500 positioned adjacent the leading face 70 of the tie 50, and (3) the vertical leg 300 positioned such that it will be adjacent to the free edge 38 of the flange 30 when the vertical leg 300 is inserted through the nearly vertical hole 320 in the tie 50. In this orientation, the location of the insertion tip 250 defines an insertion site 610 (where the hole 320 will be drilled or otherwise formed, shown in FIG. 4) on the upper surface 60 of the railroad tie 50.

At step 903, the installation may proceed by creating a nearly vertical hole 320 through the railroad tie 50 at the insertion site 610.

Step 904 includes inserting the vertical leg 300 into the hole 320 until a part of the hook-shaped portion 500 is positioned against the free edge 38 of the flange 30, as shown in FIG. 2.

Step 905 includes applying a first downward force 620 to the clip 100 until it collapses into a compressed position 700. FIG. 10 is a side view of the one-piece clip in its compressed position 700. FIG. 11 is a side-view illustration of the one-piece clip in its starting position 600, its compressed position 700, and its seated position 800. The compressed position 700 is characterized by the hook-shaped portion 500 being compressed and resting against or adjacent the free edge 38 of the flange 30. The downward force 620 may be supplied by a sledgehammer, manually, or by any other of a variety of driving tools.

Step 906 includes applying a second downward force 622 until the hook point 550 moves beyond the free edge 38 and the clip 100 expands into a seated position 800, as shown in FIG. 3. The seated position 800 is characterized by the hook point 550 being located beneath the flange 30 and positioned (1) a first vertical distance 560 downward relative to the lower surface 32 of the flange 30, and (2) a first horizontal distance 570 inward relative to the free edge 38 of the flange 30.

Although several implementations and embodiments have been described herein, those of ordinary skill in art, with the benefit of the teachings of this disclosure, will understand and comprehend many other embodiments and modifications for this technology. The invention therefore is not limited to the specific embodiments disclosed or discussed herein, and that may other embodiments and modifications are intended to be included within the scope of the appended claims. Moreover, although specific terms are occasionally used herein, as well as in the claims that follow, such terms are used in a generic and descriptive sense only and should not be construed as limiting the described invention or the claims that follow.

What is claimed is:

1. A clip for securing a railroad tie atop a support, wherein said railroad tie comprises an upper surface defining a horizontal plane and a leading face defining a vertical plane, said clip comprising:

a vertical leg positioned adjacent said support and extending through a hole in said railroad tie from an insertion tip to a first curved interconnected portion;

a horizontal leg positioned adjacent said upper surface of said railroad tie, oriented generally orthogonal to the vertical leg and at a first acute angle relative to said vertical plane, and extending from said first curved interconnected portion to a second curved interconnected portion; and a resilient hook-shaped portion extending downwardly from said second curved interconnected portion to a hook point, wherein said resilient hook-shaped portion is shaped and made such that said clip is biased toward a seated position characterized by said hook point located beneath said support.

2. The clip of claim 1, wherein said clip comprises a unitary length of metal rod made into said vertical leg, said horizontal leg, and said resilient hook-shaped portion.

3. The clip of claim 1, wherein said resilient hook-shaped portion comprises:

a shank positioned adjacent said leading face of said railroad tie and generally co-planar with said vertical plane; and a bend having an arcuate shape and extending from said shank to said hook point.

4. The clip of claim 1, wherein said support comprises a body portion and at least one flange having a lower surface, said at least one flange extending outwardly from said body portion to a free edge;

wherein said vertical leg is positioned through said hole such that said vertical leg is positioned adjacent said free edge when said clip is in said seated position; and wherein said hook point, when said clip is in said seated position, is located beneath said at least one flange and positioned a first vertical distance downward relative to said lower surface of said at least one flange and a first horizontal distance inward relative to said free edge of said at least one flange.

5. The clip of claim 4, wherein said clip is constructed of a material having a stiffness that is sufficient to permit said resilient hook-shaped portion to move from a starting position, to a compressed position, and to said seated position;

wherein said compressed position is characterized by said hook-shaped portion being located adjacent said free edge of said at least one flange;

wherein said resilient hook-shaped portion is biased toward said seated position; and wherein said clip in said starting position is substantially equivalent in shape to said clip in said seated position.

6. The clip of claim 4, wherein said first vertical distance is between about one-half inch and one inch, and wherein said first horizontal distance is between about three inches and four inches.

7. The clip of claim 1, wherein said clip is sized and shaped to secure said railroad tie to said support on a rail bed that includes no ballast surrounding said railroad tie.

8. The clip of claim 1, wherein said clip is sized and shaped to secure said railroad tie to said support without requiring a worker to labor beneath said support.

9. A method of securing a railroad tie atop a support, wherein said railroad tie comprises an upper surface defining a horizontal plane and a leading face defining a vertical plane, and wherein said support comprises a body portion and at least one flange having a lower surface, said at least one flange extending outwardly from said body portion to a free edge, said method comprising the steps of:

providing a clip comprising a unitary length of metal rod made into a vertical leg having an insertion tip, a horizontal leg, and a resilient hook-shaped portion having a hook point, wherein said resilient hook-shaped portion is shaped and made such that said clip is biased toward a seated position characterized by said hook point located beneath said at least one flange of said support;

positioning said clip atop said railroad tie with said insertion tip positioned adjacent said upper surface, said hook-shaped portion positioned adjacent said leading face, and said vertical leg positioned such that it will be adjacent to said free edge of said at least one flange when said vertical leg is inserted through a hole in said railroad tie, such that said position of said insertion tip defines an insertion site on said upper surface;

creating said hole through said railroad tie at said insertion site; inserting said vertical leg into said hole until a part of said hook-shaped portion is positioned against said free edge of said at least one flange;

applying a first downward force to said clip until said clip collapses into a compressed position, said compressed position characterized by said hook-shaped portion being located adjacent said free edge of said at least one flange; and applying a second downward force until said hook point moves beyond said free edge and said clip expands into said seated position.

10. The method of claim 9, wherein said step of creating said hole through said railroad tie comprises placing a drill bit against said insertion site, rotating said drill bit through said insertion site and into said railroad tie, and removing said drill bit.

11. The method of claim 9, wherein said step of creating said hole through said railroad tie comprises placing said insertion tip against said insertion site, and driving said vertical leg through said insertion site and into said railroad tie.

12. The method of claim 9, wherein said seated position is further characterized by said hook point being located a first vertical distance downward relative to said lower surface of said at least one flange and a first horizontal distance inward relative to said free edge of said at least one flange.

13. The method of claim 12, wherein said step of applying said second downward force further comprises applying said force until said first vertical distance is between about one-half inch and one inch, until said first horizontal distance being between about three inches and four inches, and until said horizontal leg is positioned against said upper surface of said railroad tie.

14. The method of claim 9, wherein said step of providing a clip further comprises: constructing said clip of a material having a stiffness that is sufficient to permit said resilient hook-shaped portion to collapse into said compressed position and expand into said seated position.

15. The method of claim 9, wherein said step of positioning said clip further comprises orienting said horizontal leg substantially co-planar with said upper surface of said railroad tie and substantially orthogonal to the vertical leg and at a first acute angle relative to said vertical plane, such that said horizontal leg resists rotation relative to said vertical leg.

16. The method of claim 9, further comprising the step of:

inserting a plate between said horizontal leg and said upper surface of said railroad tie; and wherein said step of applying said second downward force comprises applying said force until said horizontal leg is positioned against said plate.

17. The method of claim 9, wherein said clip is sized and shaped to secure said railroad tie to said support on a rail bed that includes no ballast surrounding said railroad tie.

18. The method of claim 9, wherein said steps of positioning, creating, inserting, applying a first downward force, and applying a second downward force are accomplished without requiring a worker to labor beneath said support.

* * * * *